US010197276B2

(12) United States Patent
Babington et al.

(10) Patent No.: US 10,197,276 B2
(45) Date of Patent: Feb. 5, 2019

(54) SYSTEM AND METHOD FOR DETECTING FLAME WITHIN A BURNER

(71) Applicant: Babington Technology, Inc., Rocky Mount, NC (US)

(72) Inventors: Andrew D. Babington, Potomac Falls, VA (US); Juan Carlos Lemus, Rocky Mount, NC (US); Nigel Jones, Frederick, MD (US); Robert L. Babington, Fairfax, VA (US); Robert S. Babington, McLean, VA (US)

(73) Assignee: BABINGTON TECHNOLOGY, INC., Rocky Mount, NC (US)

( * ) Notice: Subject to any disclaimer, the term of this patent is extended or adjusted under 35 U.S.C. 154(b) by 46 days.

(21) Appl. No.: 15/398,975

(22) Filed: Jan. 5, 2017

(65) Prior Publication Data

US 2017/0191660 A1 Jul. 6, 2017

Related U.S. Application Data

(60) Provisional application No. 62/274,879, filed on Jan. 5, 2016.

(51) Int. Cl.
*F23D 11/00* (2006.01)
*F23N 5/08* (2006.01)

(52) U.S. Cl.
CPC ..... *F23N 5/082* (2013.01)

(58) Field of Classification Search
CPC ..... F23N 5/082
USPC ..... 431/14, 78, 13, 114, 142; 340/578
See application file for complete search history.

(56) References Cited

U.S. PATENT DOCUMENTS 2,812,015 A * 11/1957 MacCracken ..... F23N 5/203 431/78
4,165,961 A * 8/1979 Yamamoto ..... B05B 17/063 239/102.2
5,126,721 A * 6/1992 Butcher ..... F23N 5/082 250/554

* cited by examiner

*Primary Examiner* — Avinash Savani
(74) *Attorney, Agent, or Firm* — Polsinelli PC

(57) ABSTRACT

A burner with a flame detector is provided. An atomizing chamber has an aperture. A flame tube is in front of the atomizing chamber, adapted to direct combusting fuel introduced by the atomizing chamber along an interior of the flame tube. A photodiode circuit is located behind the atomizing chamber. A filter is adapted to filter out signals from the photodiode outside of a predetermined bandwidth. Light from combusting fuel in the flame tube reaches the photodiode through the aperture. The output of the filter indicates the presence or absence of the flame in the flame tube based on at least whether enough light received and converted by the photodiode has a flicker rate within the predetermined bandwidth.

20 Claims, 13 Drawing Sheets

SYSTEM AND METHOD FOR DETECTING FLAME WITHIN A BURNER

CROSS REFERENCE TO RELATED APPLICATIONS

The instant application claims priority to U.S. Provisional Application 62/274,879, entitled SYSTEM AND METHOD FOR DETECTING FLAME WITHIN A BURNER, filed on Jan. 5, 2016, the contents of which are expressly incorporated by reference in its entirety.

FIELD OF THE INVENTION

Various embodiments described herein relate generally to detection of operating characteristics of a burner, such as the presence of a flame. More specifically, various embodiments described herein relate to detecting the presence of a flame in the burner by detecting the presence of light flicker consistent with a flame for the particular burner.

BACKGROUND

In a burner of solid, liquid or gaseous fuel it is of known importance to sense the presence of flame to monitor and verify burner operation. It is also important to verify correct combustion within the burner to control the emission of pollutant combustion products into the atmosphere.

A prior art methodology for detecting the presence of flame from combustion in burners is to use a photo resistor, typically of cadmium sulphide, to act as a light detector that responds to the light generated by the flame. A drawback of this methodology is that a photo resistor cannot accurately distinguish between sources of light, and can therefore give a false positive based on external light sources or even the glow of material heated by the burner. To minimize false positives the photo resistor can be located in the burner at positions that tend not to receive external light, such as the barrel of the burner, but these locations are exposed to the heat of combustion and requires a design that can withstand such extreme heat.

DRAWINGS

Various embodiments in accordance with the present disclosure will be described with reference to the drawings, in which.

DETAILED DESCRIPTION

In the following description, various embodiments will be illustrated by way of example and not by way of limitation in the figures of the accompanying drawings. References to various embodiments in this disclosure are not necessarily to the same embodiment, and such references mean at least one. While specific implementations and other details are discussed, it is to be understood that this is done for illustrative purposes only. A person skilled in the relevant art will recognize that other components and configurations may be used without departing from the scope and spirit of the claimed subject matter.

Several definitions that apply throughout this disclosure will now be presented. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series and the like. The term "a" means "one or more" unless the context clearly indicates a single element.

As used herein, the term "front", "rear", "left," "right," "top" and "bottom" or other terms of direction, orientation, and/or relative position are used for explanation and convenience to refer to certain features of this disclosure. However, these terms are not absolute, and should not be construed as limiting this disclosure.

Shapes as described herein are not considered absolute. As is known in the burner art, surfaces often have waves, protrusions, holes, recess, etc. to provide rigidity, strength and functionality. All recitations of shape (e.g., cylindrical) herein are to be considered modified by "substantially" regardless of whether expressly stated in the disclosure or claims, and specifically accounts for variations in the art as noted above.

It is an object of at least some embodiments of the invention to provide a flame detector that can detect optical flicker characteristics of the flame based on the type of fuel being burned.

Flame tends to have an associated frequency, known as the flicker frequency. In general fire has a flicker frequency of 1-40 Hz, although the frequency tends to be different for particular type of fuel and/or burning environment. At least some embodiments of the invention specifically react to the presence of significant light at that frequency range to the exclusion of light at other frequencies. By way of non-limiting example, the AIRTRONIC atomizing burner sold by BABINGTON TECHNOLOGY burns diesel fuel at a flicker rate predominately within from 5 Hz to 40 Hz.

Figure 1:
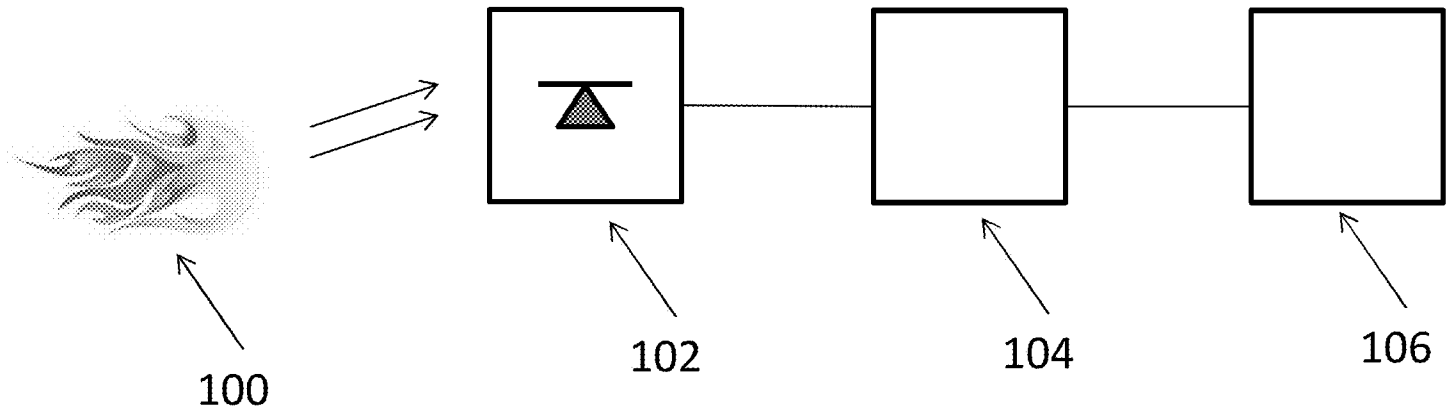
FIG. 1 shows an embodiment of the invention.

Referring now to FIG. 1, an embodiment of the invention includes a burner with a photodiode circuit including one or more photodiodes (the photodiode circuit referred to herein generically as photodiode 102) that can detect the AC component (flicker) and DC component (absolute light level) of light from a flame 100.

Photodiode 102 may be reactive to all light. Photodiode 102 may also have a higher sensitivity to yellow light rather than orange or red light, as yellow is common to fire while red and orange are common to the glow from hot metal heated by the burner. Photodiode 102 may also have a higher sensitivity to blue light rather than other light (or in addition to other specific light such as yellow), as blue is common to fire for certain fuels such as natural gas. Photodiode 102 is mounted in the burner at a position to observe where the flame 100 would be found.

The output of photodiode 102 is sent to a filter 104, which may be a band pass filter. Filter 102 removes any DC component of the output of photodiode 102. The frequency range of the filter 104 is also set to encompass the expected flicker rate of flame from the burner for the particular fuel, but preferably exclude frequencies of typical light sources (e.g., 50 Hz and higher for external light bulbs). By way of non-limiting example, the range could be set to about ±3 Hz around the expected flicker frequency (e.g., 11-17 Hz for a 14 Hz flicker rate), or around a greater range (e.g., 5-40 Hz for particular flicker rate), or to simply remove frequencies of typical light sources (e.g., 50 Hz and above). Significant output of filter 104 will thus indicate the presence of flame based on the presence of light having the expected color and flicker rate. In contrast, any output of filter 104 will be significantly lower in response to other sources of light, and such sources would tend to be a different color and/or flicker rate than passed by the embodiment.

The output of filter 104 is sent to a control 106 (either directly or through intervening circuitry). The presence of a substantial signal for output of filter 104 indicates the presence of a flame, and controller 106 can respond accordingly. Similarly, the absence of a substantial signal (e.g., no signal, a noise signal, or other de minimus signal consistent with minimal reaction to light from other sources) indicates the absence of a flame.

Figure 10:
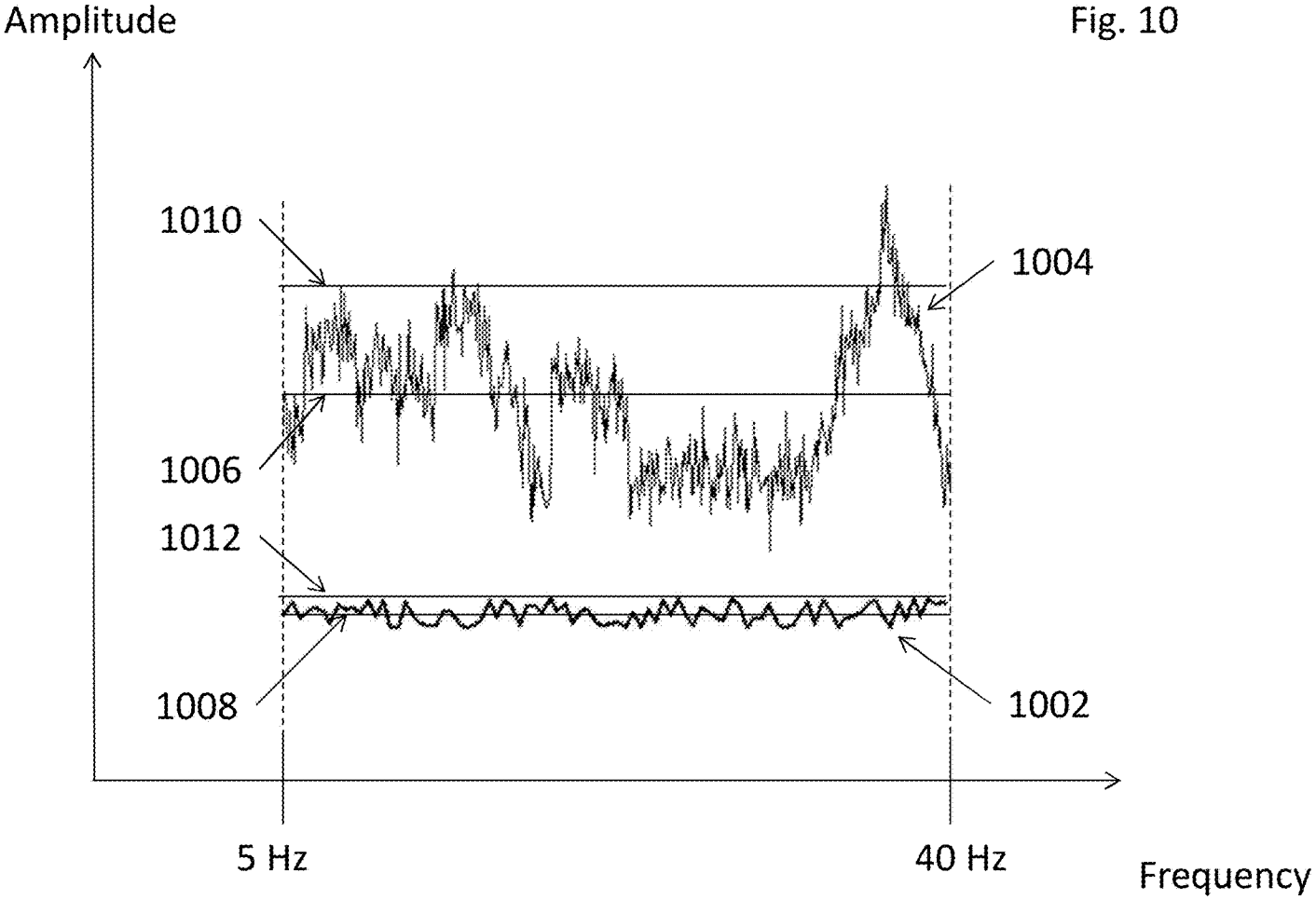
FIG. 10 shows a hypothetical not to scale representation of the output of band pass filter 104 set for a frequency of 5-40 Hz.

By way of non-limiting example, FIG. 10 shows a hypothetical not to scale representation of the output of band pass filter 104 set for a frequency of 5-40 Hz. The output for filter 104 in the absence of flame is shown at 1002; there may be some signal present, although it can be considered consistent with background noise or other remote sources of light. The output of filter 104 in the presence of flame is shown at 1004, which is significantly more active than 1002.

Controller 106 determines whether the output of filter 104 is consistent with the absence or presence of flame, such as by requiring a predetermined minimum value of the output of filter 104 to be considered the presence of flame. One methodology of determination is to take the average of the output of filter 104 over a period of time (e.g., a repeating 100 ms window); in the presence of flame, the average 1006 for signal 1004 could be on the order of 3 times the expected amplitude of the average 1008 of signal 1002 for the absence of flame. Another methodology is to take the average of the peaks of the signal within the window; in the presence of flame, the average 1010 for signal 1004 could be on the order of 10 times the amplitude of the expected average of 1012 of signal 1002 for the absence of flame. Memory associated with controller 106 may store a predetermined value by which the above averages are compared. The invention is not limited to the manner in which controller 106 interprets the output of filter 104 to determine the absence or presence of flame.

Filter 104 may be hardware, software, or a combination thereof. Controller 106 similarly may be hardware, software, or a combination thereof. Filter 104 and controller 106 may be distinct components, integrated components, or overlapping components. By way of non-limiting example, filter 104 and controller 106 may both be software run on a processor of a common control, such as microcomputer 206 shown in FIG. 2. The invention is not limited to the implementation of the filter 104 and/or controller 106.

Figure 2:
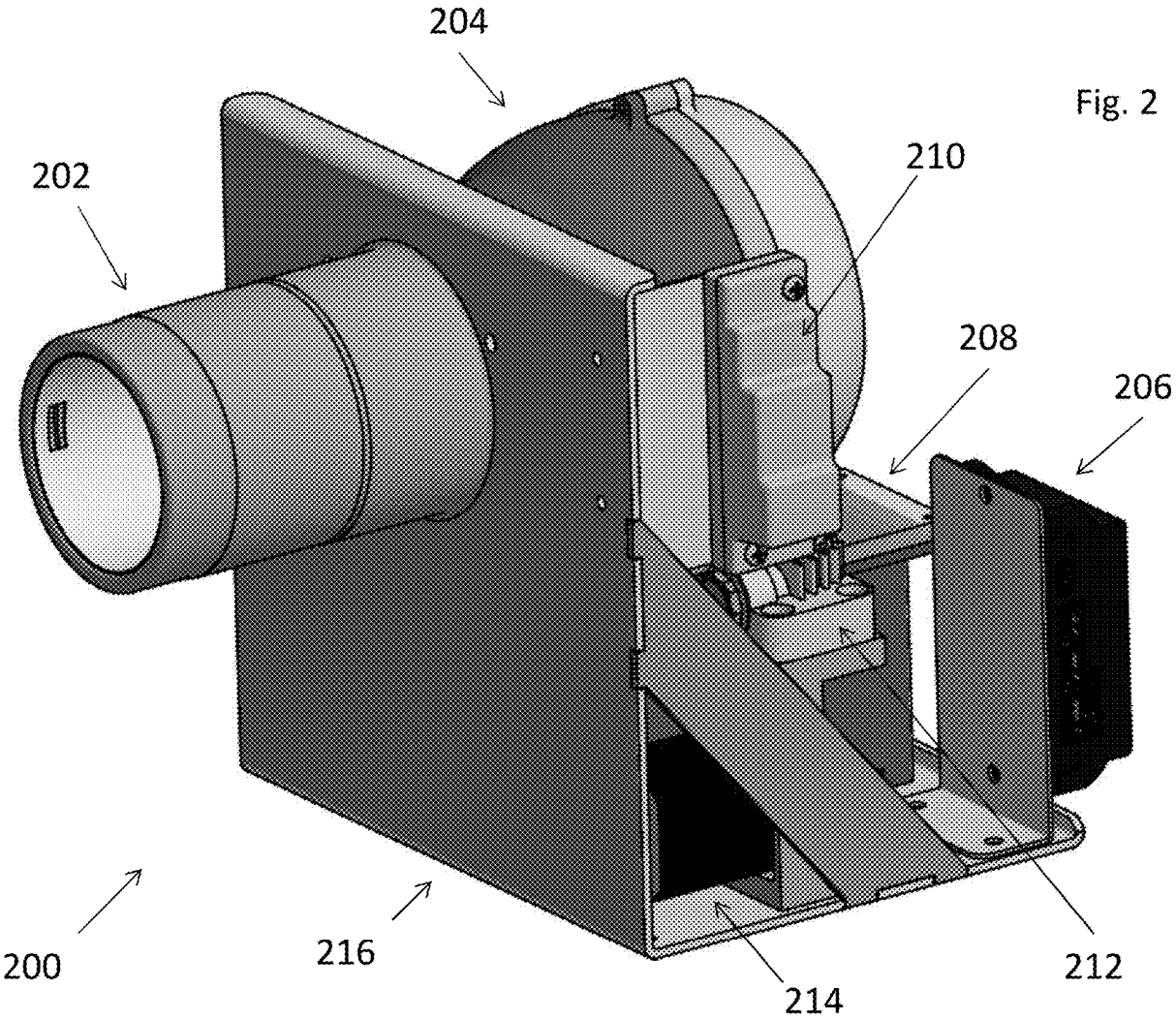
FIG. 2 shows an embodiment of the invention inside of a burner.
Figure 3:
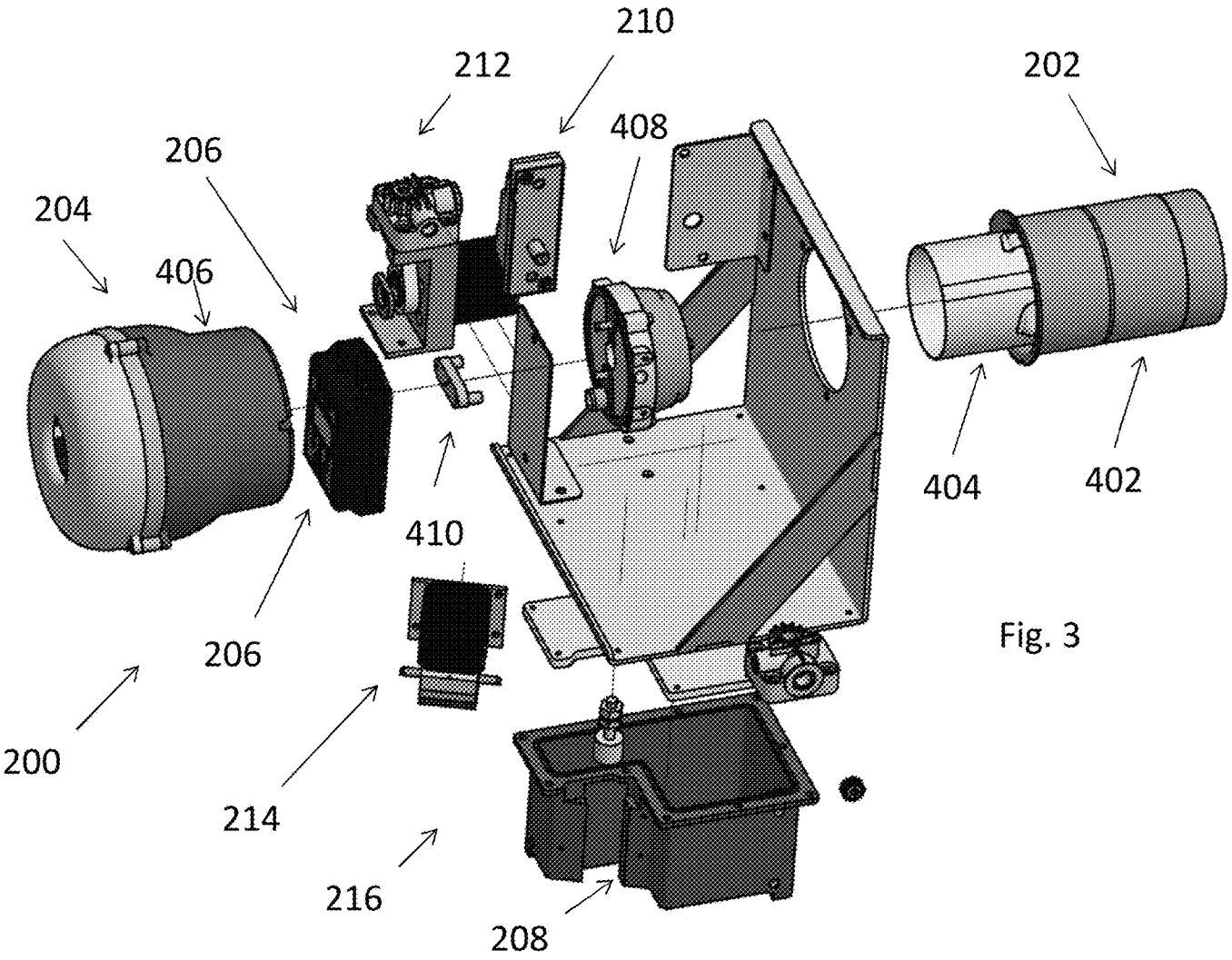
FIG. 3 is an exploded view of the embodiment of FIG. 2.

Referring now to FIGS. 2 and 3, and non-limiting example of a burner 200 that can utilize the photodiode 102 is shown. Burner 200 includes a flame tube 202, a blower 204, a microcomputer 206 (which may be controller 106 or a distinct component, work in combination with controller 106, overlap in functionality with controller 106, or include controller 106 along with other functionality), a fuel reservoir 208, an igniter transformer 210, a compressor 212, and a fuel metered pump 214. The various components are supported by a housing 216.

Figure 4:
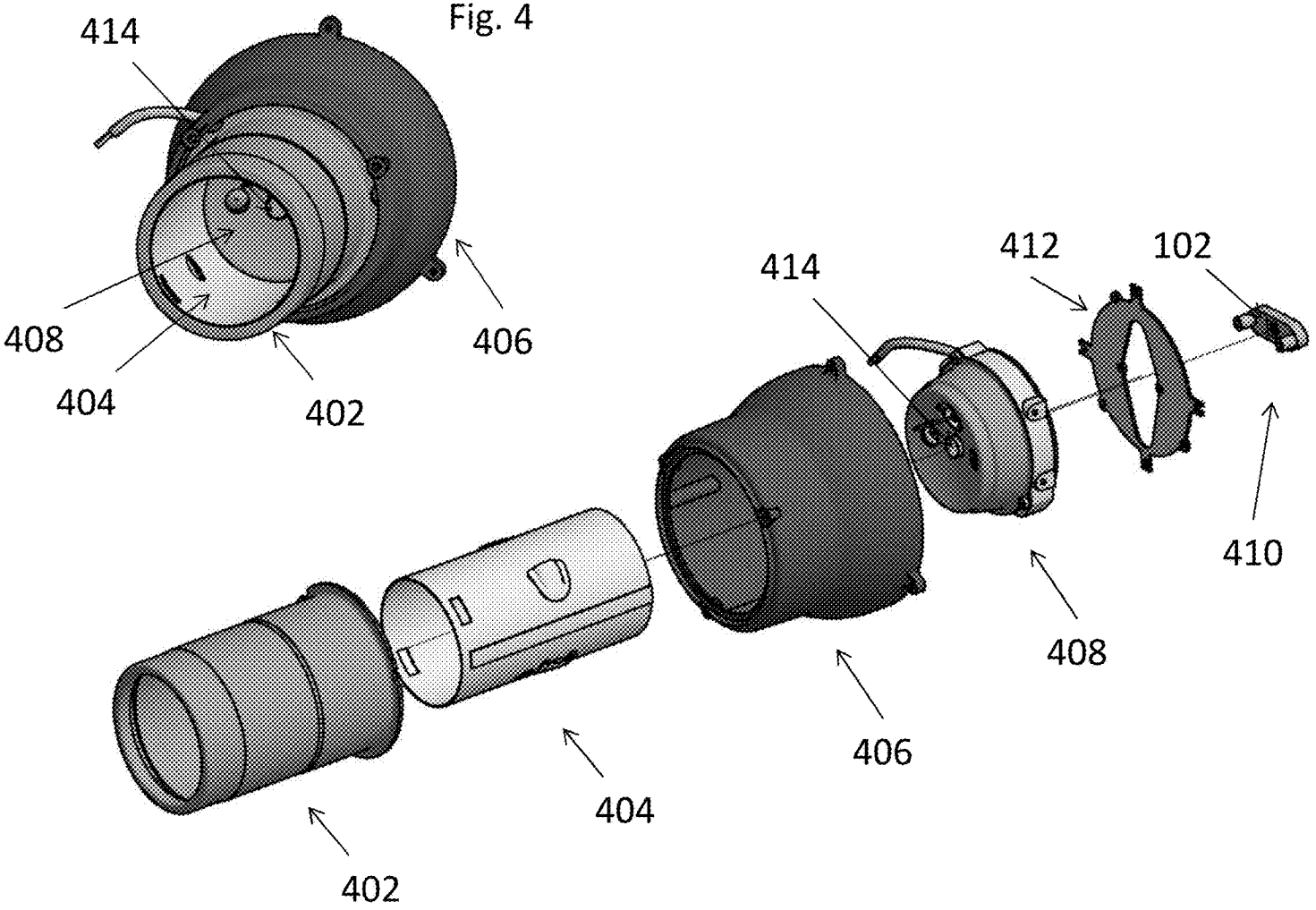
FIG. 4 shows the atomizing chamber and flame tube of FIG. 2.

Referring now to FIGS. 3 and 4, the combustion chamber components of burner 200 are described in more detail. Flame tube 202 may include an outer barrel 402 and an inner barrel 404. An atomizing chamber 408 is rearward of the flame tube 202, and receives fuel from fuel reservoir 208 (pathway not shown). A mounting ring 412 is mounted on the rear of atomizing chamber 408. A support 410 is mounted in rearward of ring 412, and supports photodiode 102. Atomizing head 408 includes an aperture 414 substantially at the center thereof, through which light from within flame tube 202 can reach photodiode 102. A casing 406 (which is part of the blower 204) has a flange that engages with the rear of outer barrel 402. Components are connected and mounted in manners known in the burner art and not further discussed herein.

In operation, igniter transformer 210 ignites atomized fuel sprayed by atomizing chamber 408 to generate a flame plume in flame tube 202 toward the distal end of flame tube 202, and may depend on operating conditions extend beyond the distal end of flame tube 202. Light from the flame passes through aperture 414 onto photodiode 102. Light within the flicker rate passed by the filter 104. Filter 104 will thus output a signal consistent with the presence of flame, and controller 106 can respond accordingly. To the extent that color sensitivity is also provided (e.g., yellow and/or blue), then sources of light from a different color at the noted flicker rate would be disregarded as non-indicative of the presence of flame.

After the flame is extinguished, the photodiode 102 will cease to output corresponding signal from the flame's light. There may be other sources of light (i.e., ambient light, heated metal in the flame tube 202) that photodiode 102 reacts to, but would not produce a meaningful and/or sufficient output from filter 104 due to the absence of the corresponding color (if burner 200 is color sensitive) and/or the lack of flicker rate at the frequency of filter 104 (which may be part of microcomputer 206 or a distinct component, work in combination with microcomputer 206 or overlap in functionality with microcomputer 206). The absence of meaningful/sufficient output from filter 104 is interpreted by controller 106 as the absence of flame in the flame tube 202.

Figure 5:
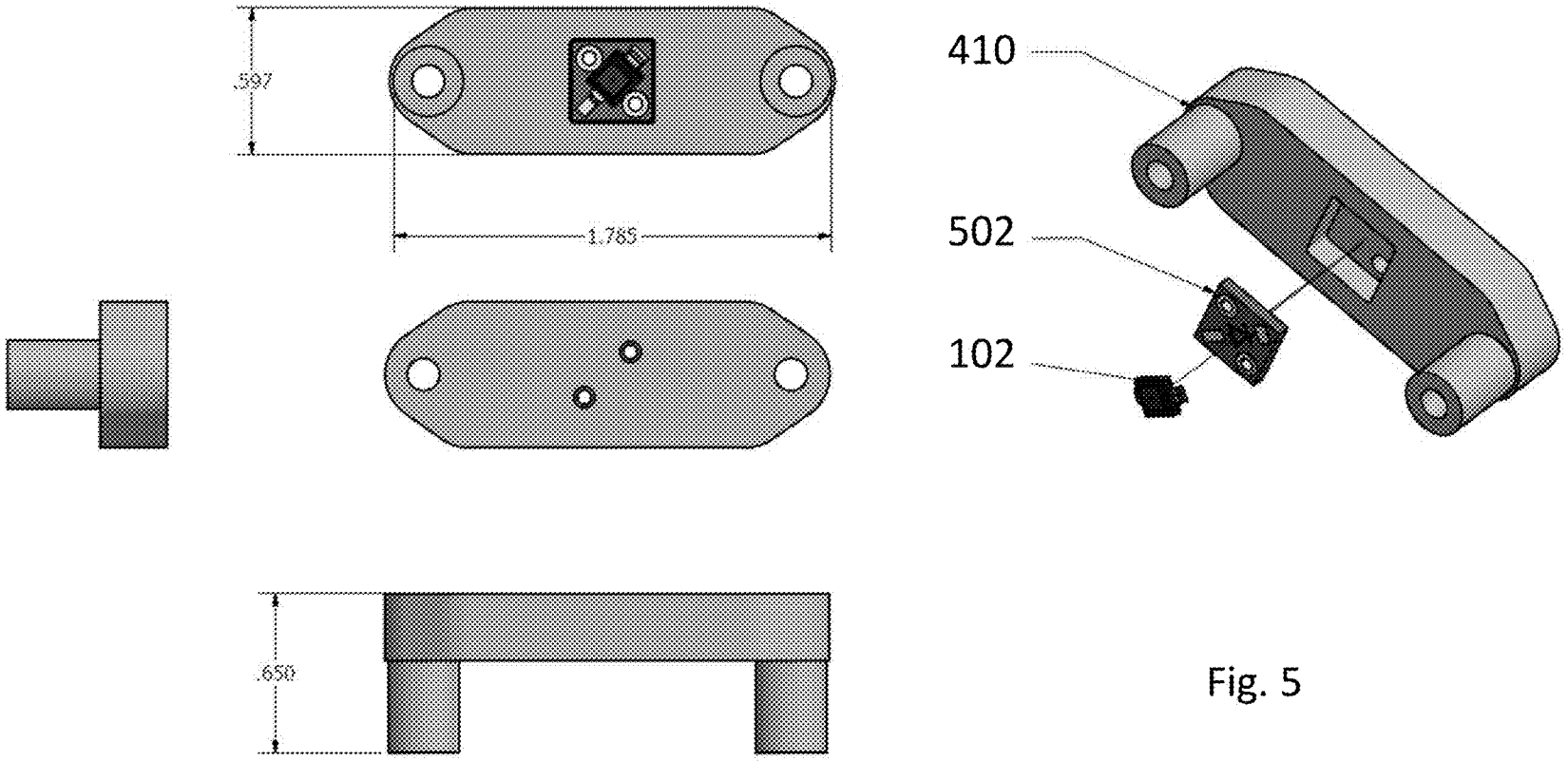
FIG. 5 shows the support and photodiode of FIG. 2.
Figure 6:
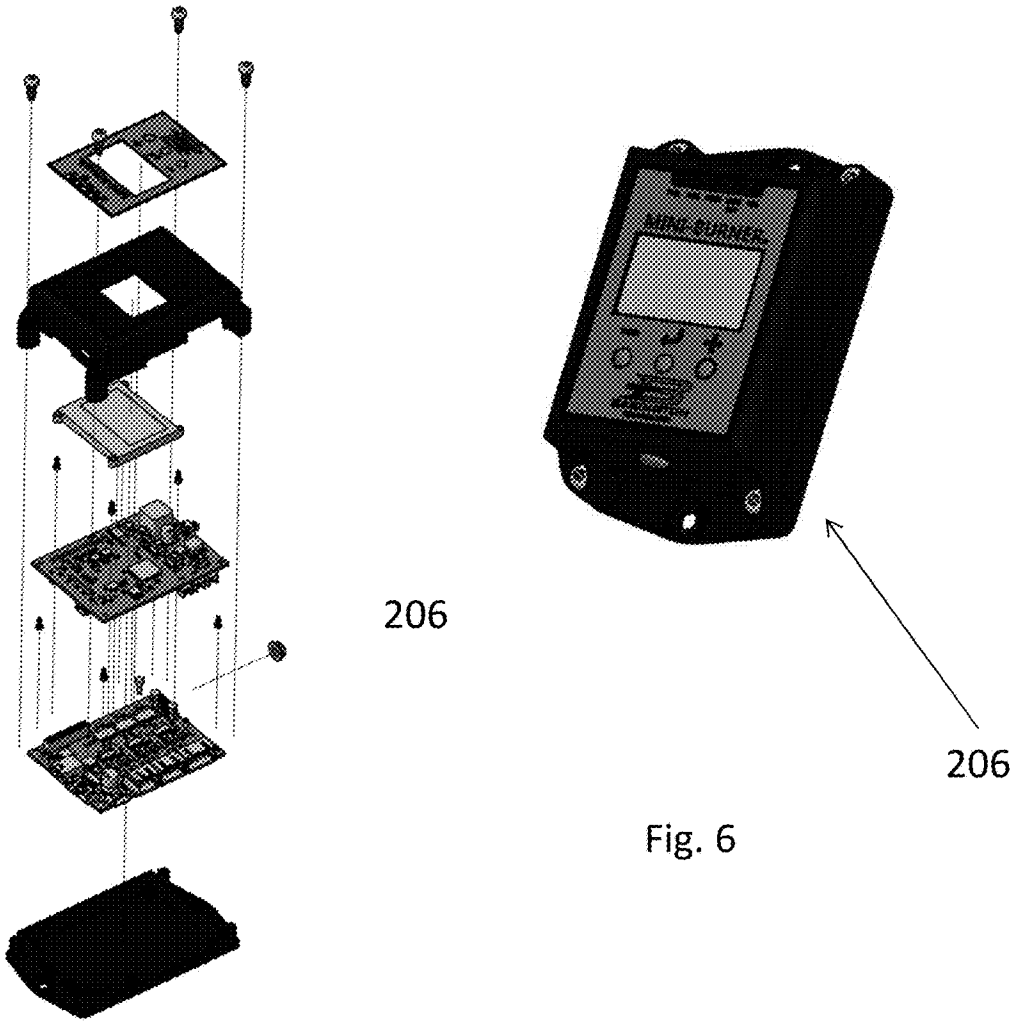
FIG. 6 shows the microcomputer of FIG. 2.
Figure 7:
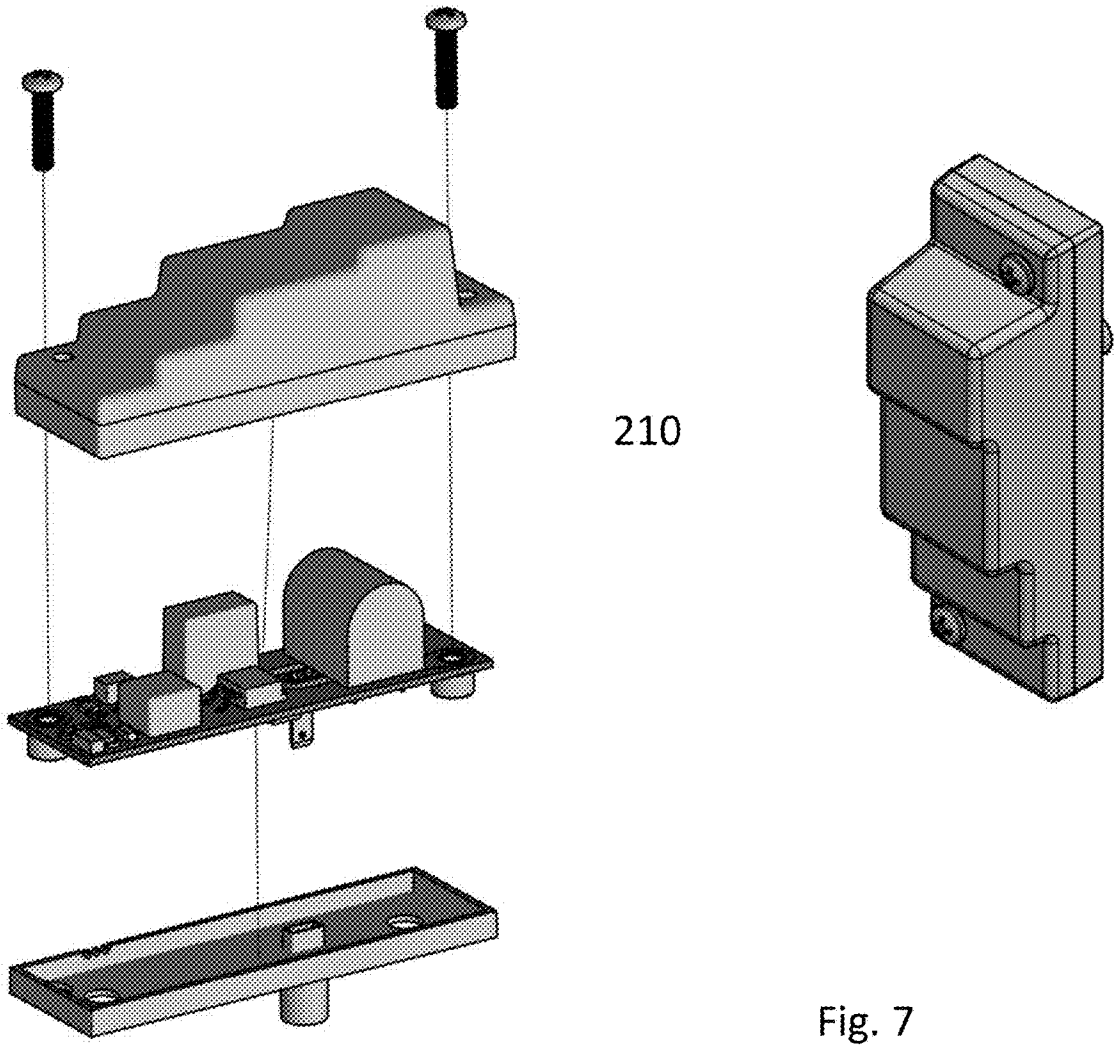
FIG. 7 shows the ignitor transformer of FIG. 2.
Figure 8:
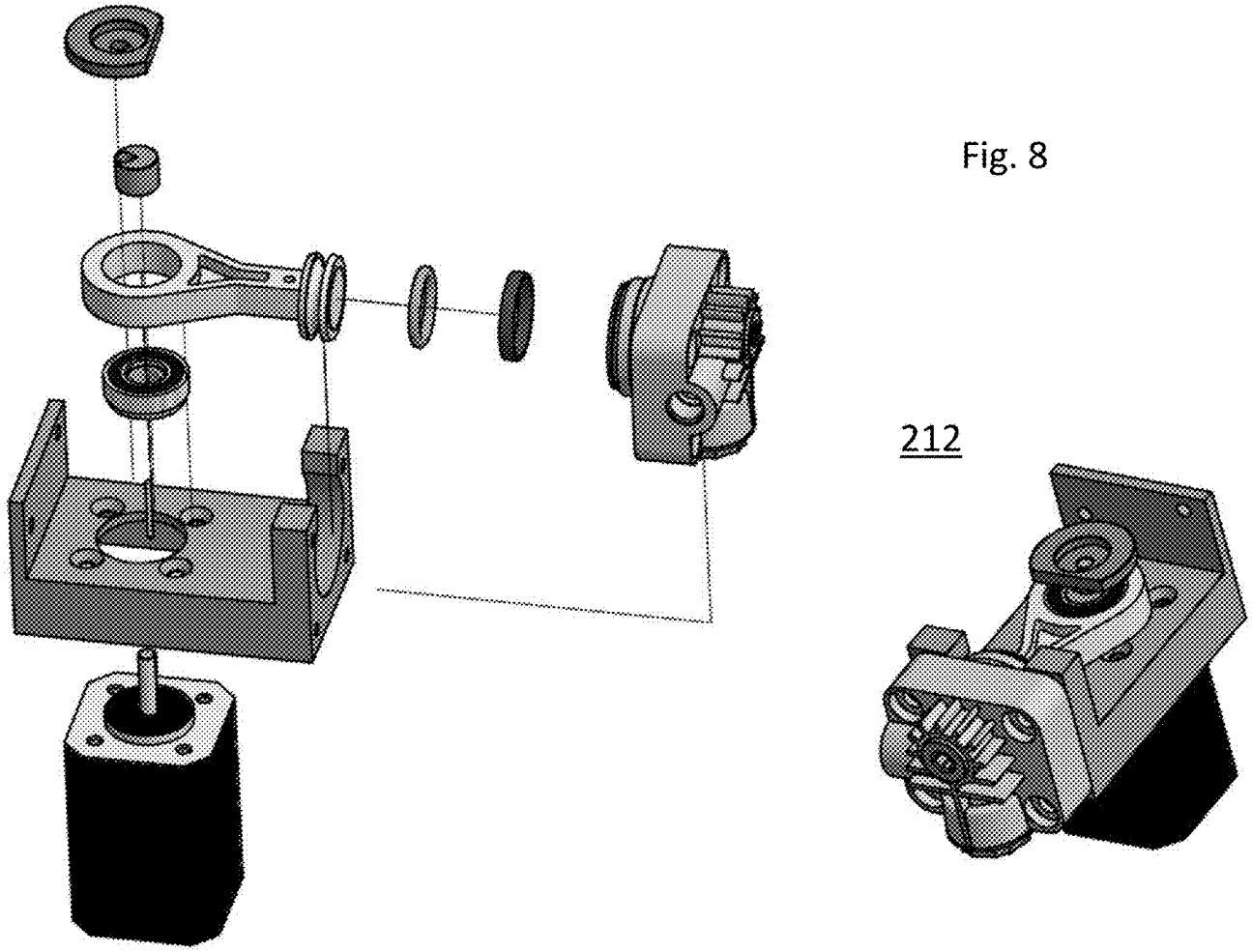
FIG. 8 shows the compressor of FIG. 2.
Figure 9:
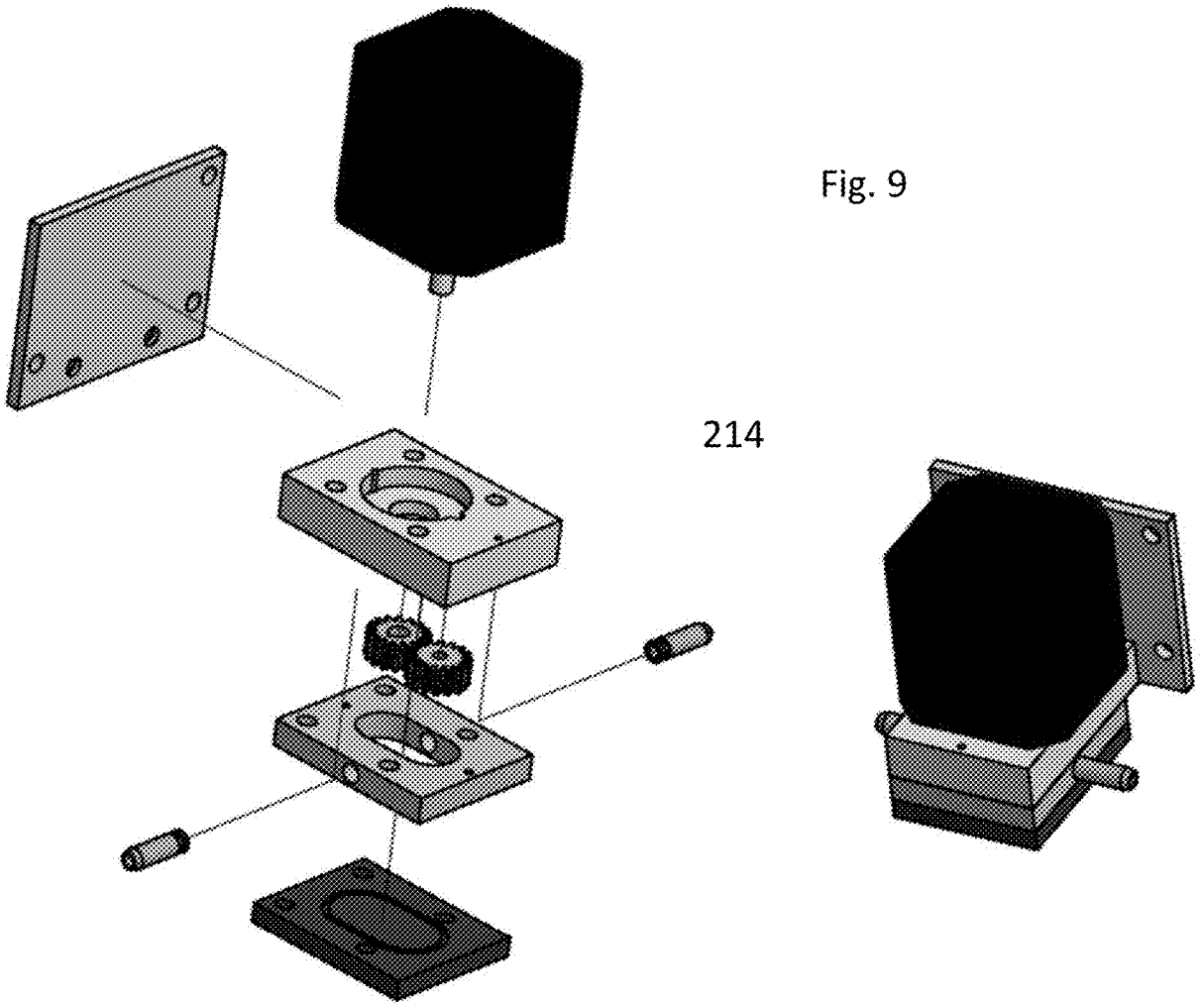
FIG. 9 shows the fuel metered pump of FIG. 2.

FIG. 5 shows a variety of views of support 410 and photodiode 102. Photodiode 102 is mounted on a circuit board 502, which in turn is mounted on support 410. Circuit board 502 is connected via appropriate wires (not shown) to microcomputer 206. Circuit board 502 may support other circuits as desirable.

FIGS. 6-9 show various views of the structure of microcomputer 206, igniter transformer 210, compressor 212, and fuel metered pump 214, respectively.

The above embodiment provides several advantages of the light detector of the prior art. Since the components can be selected to specifically detect and respond to sources of light consistent with the flame produced by the fuel type and architecture, it is not significantly responsive to other forms of light. This allows the photodiode 102 to be placed rear of the atomizing chamber 408, which is not exposed to the heat of the emerging flame and thus does not require a heat tolerant design. A light detector of the prior art could not be placed at this location due to its reactiveness to other forms of light, which required it to be mounted in a heat exposed position and required a heat tolerant design.

Burner 200 as shown herein is simply exemplary, and other burners (particularly atomizing burners of BABING- TON TECHNOLOGY) may also be used. The invention is not limited to the burner environment.

Figure 11:
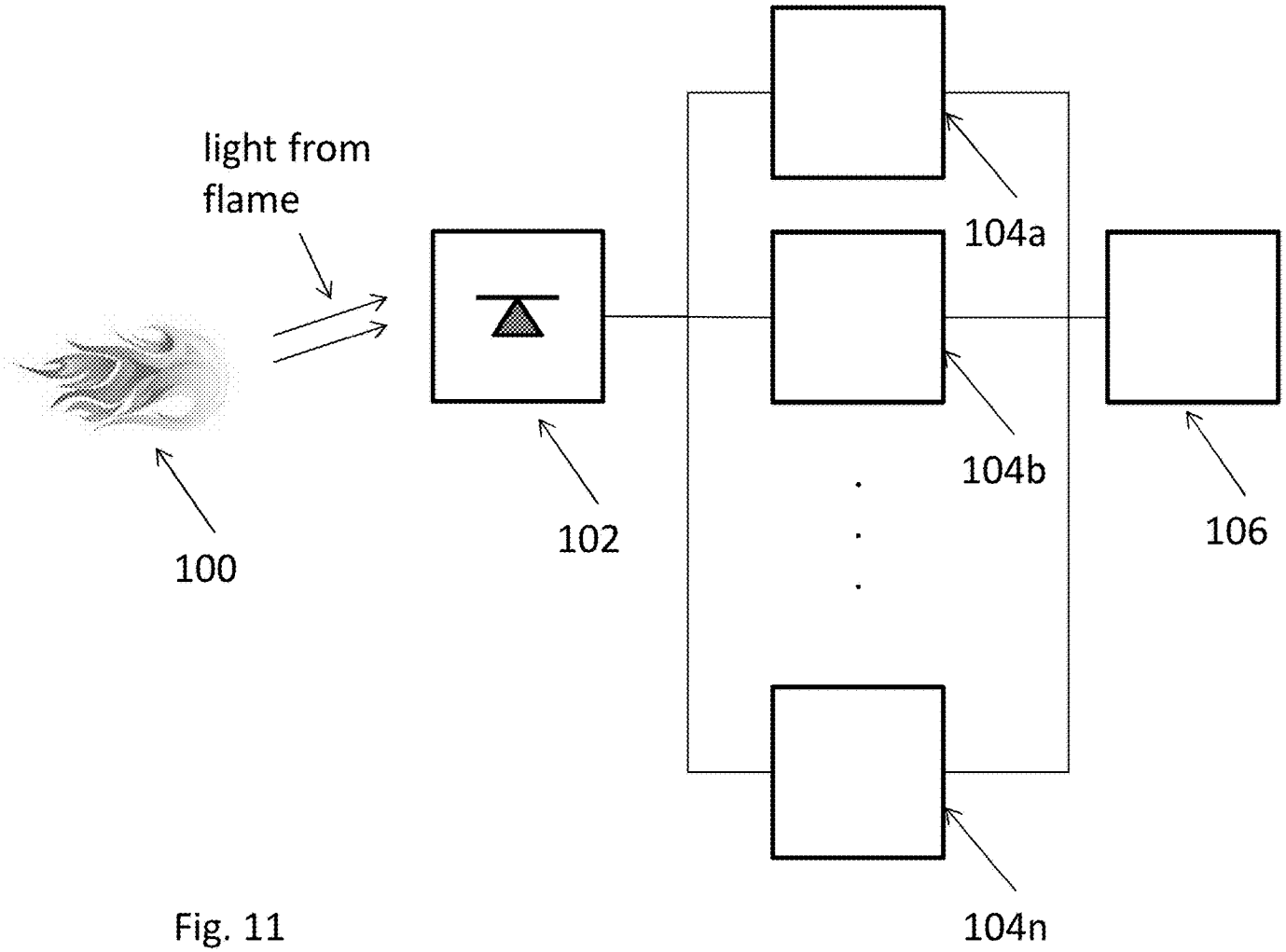
FIG. 11 shows another embodiment of the invention.

Referring now to FIG. 11, another embodiment of the invention is shown. As noted above, different fuels may emit light at different frequency ranges, and may peak at different ranges. Control 106 can identify the type of fuel if the predominance of light received at a particular frequency range corresponds to that fuel. In this embodiment, the burner includes several filters 104*a*-104*n*, where n is at least two (2) (referred to generically as 104*x*). Each filter 104*x* may pass a different range of light. By way of non-limiting example, filter 104*a* may be set to pass 5-40 Hz for flame detection as above, filter 104*a* may be set to pass 11-17 Hz (14 Hz±3) for a particular fuel, and filter 104*c* may be set to pass 23-30 Hz (27 Hz±3) for a different type of fuel. A filter 104*x* could be set to only pass the DC component of the light from photodiode 102, which may be useful for certain calculations (e.g., how much flame is present). Any number of filters may be provided, for overlapping or distinct ranges, for the purpose of detection of flame and/or detection of a particular type of fuel.

Figure 12:
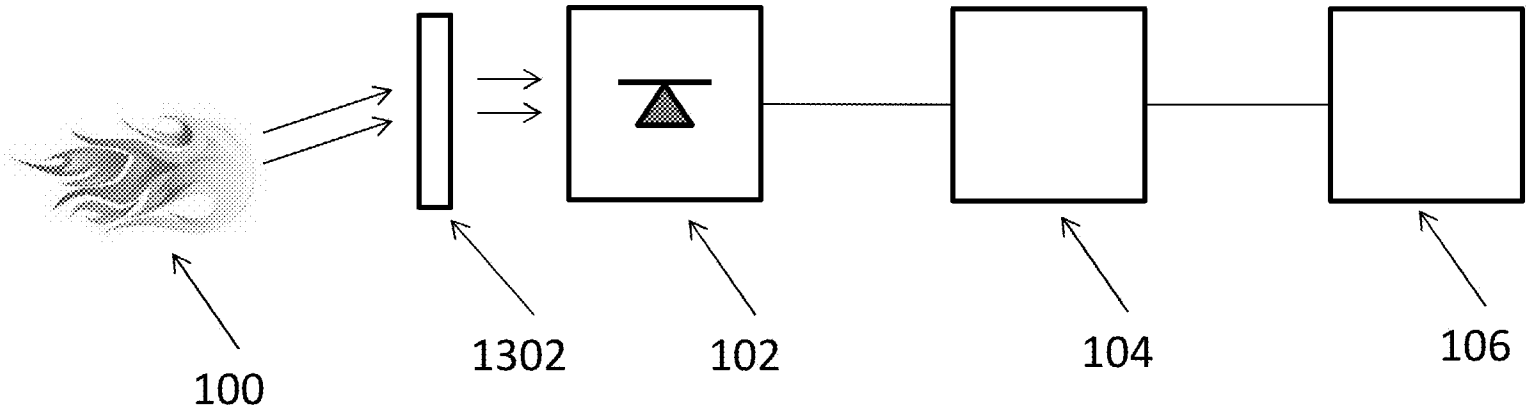
FIG. 12 shows another embodiment of the invention.
Figure 13:
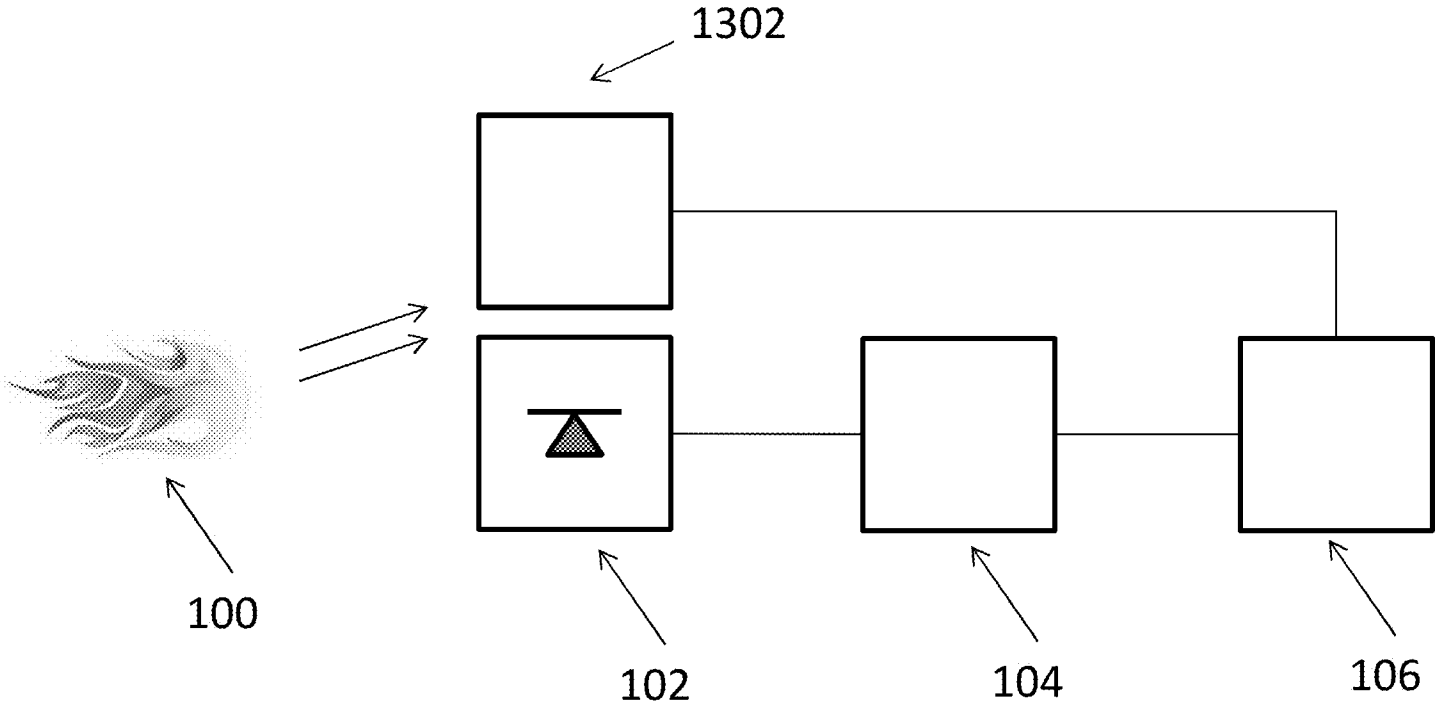
FIG. 13 shows another embodiment of the invention.

As discussed above, burner 200 may optionally be color sensitive, such as by photodiode 102 being a specific wavelength diode with a higher sensitivity to yellow light rather than orange or red light. However, the invention is not so limited, and other forms of color sensitivity may be provided. By way of non-limiting example, photodiode 102 may be, or at least partially contain, a color sensing circuit that can detect different colors of incoming light, for which filter 104 and/or controller 106 would process the yellow light to the exclusion of other colors of light. A mechanical, optical and/or electrical filter 1202 could be placed in front of photodiode 102 to only pass color light such as in FIG. 12. A separate color sensing circuit 1302 could also be provided separate from or partially overlap with photodiode 102, such as in FIG. 13, and mounted rearward of atomizing chamber of 408 (e.g., mounted on support 410). The invention is not limited to the particular manner in which the color of the flame is determined.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A burner with a flame detector, comprising:
an atomizing chamber having an aperture;
a flame tube in front of the atomizing chamber, adapted to direct combusting fuel introduced by the atomizing chamber along an interior of the flame tube;
a photodiode circuit located behind the atomizing chamber;
a filter adapted to filter out signals from the photodiode outside of a predetermined bandwidth;
wherein light from combusting fuel in the flame tube reaches the photodiode through the aperture;
wherein output of the filter indicates the presence or absence of flame in the flame tube based on at least whether enough light received and converted by the photodiode and corresponding signal passed through the filter has a flicker rate of flame within the predetermined bandwidth.

2. The burner of claim 1, wherein the predetermined bandwidth of the filter is based on a flicker rate of the combusting fuel.

3. The burner of claim 2, wherein the predetermined bandwidth is within about 5-40 Hz.

4. The burner of claim 2, wherein the predetermined bandwidth excludes 50 Hz and higher.

5. The burner of claim 1, further comprising a microcomputer programmed to determine the presence or absence of flame from the output of the filter based on whether enough light received and converted by the photodiode has a flicker rate within the predetermined bandwidth.

6. The burner of claim 5, wherein the filter is part of the microcomputer.

7. The burner of claim 1, wherein the filter comprises a plurality of filters, at least two of the filters having different predetermined bandwidths.

8. The burner of claim 7, further comprising a DC filter to pass the DC component of the diode output.

9. A burner with a flame detector, comprising:
an atomizing chamber having an aperture;
a flame tube in front of the atomizing chamber, adapted to direct combusting fuel introduced by the atomizing chamber along an interior of the flame tube;
light detection circuitry located behind the atomizing chamber, the light detection circuitry being adapted to convert into an electrical signal light received through the aperture;
a filter adapted to filter out, from the electrical signal of the light detection circuitry, signal content that is outside of a predetermined bandwidth;
a controller adapted to receive the filtered electrical signal, and to determine the presence or absence of flame based at least on whether enough light received and converted by the light detection circuitry and corresponding electrical signals from the light detection circuitry passed through the filter has a flicker rate of flame within the predetermined bandwidth.

10. The burner of claim 9, wherein the light detection circuitry is more sensitive to at least one particular color of visible light as compared to other colors, such that the presence of light having the at least one particular color has greater contribution to the electrical signal than the presence of light at the other colors.

11. The burner of claim 10, wherein the at least one color of visible light is a yellow consistent with combusting diesel fuel or a blue consistent with combusting natural gas.

12. The burner of claim 9, wherein the controller determines the presence or absence of flame based on at least a color of light received through the aperture from combusting fuel in the flame tube.

13. The burner of claim 9, further comprising:
color detection circuitry located behind the atomizing chamber, the color detection circuitry being adapted to identify the color of light received through the aperture; and
the controller is adapted to determine the presence or absence of flame based at least on a color of the received light.

14. The burner of claim 13, wherein the color detection circuitry is incorporated into the light detection circuitry, distinct from the light detection circuitry, or partially overlaps with the light detection circuitry.

15. The burner of claim 9, wherein the predetermined bandwidth is within about 5-40 Hz.

16. A burner with a flame detector, comprising:
an atomizing chamber having an aperture;
a flame tube in front of the atomizing chamber, adapted to direct combusting fuel introduced by the atomizing chamber along an interior of the flame tube;

a light detector located behind the atomizing chamber;

a filter adapted to filter out signals from the light detector outside of a predetermined bandwidth, the predetermined bandwidth of the filter being based on a flicker rate of the combusting fuel;

wherein light from combusting fuel in the flame tube reaches the light detector through the aperture;

wherein output of the filter indicates the presence or absence of flame in the flame tube based on at least whether enough light received and converted by the light detector and corresponding signal passed through the filter has a flicker rate of flame within the predetermined bandwidth.

17. The burner of claim 16, wherein the predetermined bandwidth is within about 5-40 Hz.

18. The burner of claim 16, wherein the predetermined bandwidth excludes 50 Hz and higher.

19. A burner with a flame detector, comprising:

an atomizing chamber having an aperture;

a flame tube in front of the atomizing chamber, adapted to direct combusting fuel introduced by the atomizing chamber along an interior of the flame tube;

a light detector located behind the atomizing chamber, the light detector being adapted to convert into an electrical signal light received through the aperture;

a filter adapted to filter out, from the electrical signal of the light detector, signal content that is outside of a predetermined bandwidth;

a controller adapted to receive the filtered electrical signal, and to determine the presence or absence of flame based at least on (a) whether enough light received and converted by the light detector and corresponding electrical signals from the light detector passed through the filter has a flicker rate of flame within the predetermined bandwidth and (b) at least a color of light received through the aperture from combusting fuel in the flame tube.

20. The burner of claim 19, further comprising:

a color detector located behind the atomizing chamber, the color detector being adapted to identify the color of light received through the aperture; and the controller is adapted to determine the presence or absence of flame based at least on a color of the received light as identified by the color detector.

* * * * *